US011217215B2

(12) United States Patent
Coyle

(10) Patent No.: US 11,217,215 B2
(45) Date of Patent: Jan. 4, 2022

(54) SOUND ENHANCING ACCESSORY FOR A MUSICAL INSTRUMENT

(71) Applicant: TONIK SOUND LIMITED, London (GB)

(72) Inventor: Michael Robert Coyle, London (CA)

( * ) Notice: Subject to any disclaimer, the term of this patent is extended or adjusted under 35 U.S.C. 154(b) by 0 days.

(21) Appl. No.: 16/964,017

(22) PCT Filed: Jan. 17, 2019

(86) PCT No.: PCT/CA2019/000004
§ 371 (c)(1),
(2) Date: Jul. 22, 2020

(87) PCT Pub. No.: WO2019/144216
PCT Pub. Date: Aug. 1, 2019

(65) Prior Publication Data

US 2020/0410969 A1 Dec. 31, 2020

(30) Foreign Application Priority Data

Jan. 26, 2018 (GB) ..... 1801332

(51) Int. Cl.
*G10H 3/18* (2006.01)
*G10D 3/01* (2020.01)
(Continued)

(52) U.S. Cl.
CPC ..... *G10H 3/18* (2013.01); *G10D 1/08* (2013.01); *G10D 3/01* (2020.02); *G10H 1/342* (2013.01);
(Continued)

(58) Field of Classification Search
CPC combination set(s) only.
See application file for complete search history.

(56) References Cited

U.S. PATENT DOCUMENTS 5,010,803 A * 4/1991 Donnell ..... G10H 3/14 84/723
5,105,711 A 4/1992 Barnard
(Continued)

FOREIGN PATENT DOCUMENTS

WO 2010/112183 A1 10/2010

OTHER PUBLICATIONS

PCT/CA2019/000004, Notification of Transmittal of the International Search Report and the Written Opinion of the International Searching Authority, or the Declaration, dated Apr. 18, 2019, 10 pgs.

*Primary Examiner* — Jeffrey Donels
(74) *Attorney, Agent, or Firm* — Kagan Binder, PLLC

(57) ABSTRACT

An accessory for modifying sound output of a musical instrument. The body of the instrument has a soundboard. The accessory includes a sound sensor, an actuator, a fastener, and a controller. The sound sensor engages the body and senses vibration of the body representing the sound output of the musical instrument. The actuator engages the soundboard and deforms the soundboard of the musical instrument so as to modify the sound output of the musical instrument. The sound sensor is preferably arranged distally to the actuator. The fastener engages the accessory to the musical instrument, to locate the actuator against the soundboard of the musical instrument. The controller is connected to the actuator and the sound sensor for receiving and analysing the sound output sensed by the sound sensor, and controlling the actuator in dependence on the sound output sensed by the sound sensor.

24 Claims, 9 Drawing Sheets

(51) Int. Cl.
*G10D 1/08* (2006.01)
*G10H 1/34* (2006.01)

(52) U.S. Cl.
CPC . *G10H 2220/165* (2013.01); *G10H 2220/525* (2013.01)

(56) References Cited

U.S. PATENT DOCUMENTS

| | | | | |
|---|---|---|---|---|
| 5,614,688 | A * | 3/1997 | Donnell | G10H 3/181 84/743 |
| 9,111,517 | B2 * | 8/2015 | Webman | G10H 3/22 |
| 9,390,699 | B2 * | 7/2016 | Huang | G10H 3/183 |
| 9,412,347 | B2 * | 8/2016 | Kobayashi | H04R 1/24 |
| 9,424,824 | B2 * | 8/2016 | Webman | G10H 1/045 |
| 9,704,465 | B2 * | 7/2017 | Webman | G10H 1/047 |
| 9,865,239 | B1 * | 1/2018 | White | G10H 1/0083 |
| 10,475,429 | B2 * | 11/2019 | Iori | G10H 3/186 |
| 10,540,949 | B2 * | 1/2020 | Ekuni | G10H 1/12 |
| 10,621,965 | B2 * | 4/2020 | Abiko | G10D 3/04 |
| 10,770,047 | B2 * | 9/2020 | Litovsky | H04R 1/345 |
| 2006/0117938 | A1 * | 6/2006 | Gillette | G10H 3/186 84/723 |
| 2009/0064853 | A1 * | 3/2009 | Gillette | G10H 3/26 84/725 |
| 2011/0192273 | A1 * | 8/2011 | Findley | G10H 1/36 84/743 |
| 2013/0263721 | A1 | 10/2013 | Shavit | |
| 2014/0224099 | A1 * | 8/2014 | Webman | G10H 3/18 84/630 |
| 2015/0356960 | A1 * | 12/2015 | Webman | G10H 1/0091 84/630 |
| 2017/0018265 | A1 * | 1/2017 | Webman | G10H 3/24 |

* cited by examiner

SOUND ENHANCING ACCESSORY FOR A MUSICAL INSTRUMENT

PRIORITY CLAIM

This application claims benefit from International Application No. PCT/CA2019/000004, filed Jan. 17, 2019, which in turn claims priority to Great Britain application having Ser. No. 1801332.6, filed on Jan. 26, 2018, both of which are incorporated herein by reference in their entireties for all purposes.

FIELD OF THE INVENTION

This invention relates to a sound enhancing accessory for a musical instrument. In particular, the invention relates to an accessory for modifying the sound output of a musical instrument.

BACKGROUND OF THE INVENTION

Musical instruments produce sound by the actuation of a medium—for example, the strings of stringed instruments are actuated directly with a hand, or a hand-held bow or hammer, for example. The actuated medium (e.g. string) vibrates, producing sounds, and different sounds are produced by actuating different media and/or by modifying the properties of a given medium and/or the way it is actuated (e.g. the length of a string and how hard it is struck, plucked, or bowed, for example).

Sounds produced by a musical instrument in this way can be amplified and/or otherwise modified by the body of the musical instrument. For example, the body of a guitar comprises a hollow chamber with an opening (sound hole); the sound produced by the actuated strings causes the chamber to resonate and vibrate, producing additional sounds and amplifying, enhancing and/or otherwise modifying the sound produced by the strings of the guitar.

The array of sounds that can be produced by an acoustic instrument is determined by the properties of the vibrating media actuated during the playing of the instrument, as well as the construction (such as the body) of the musical instrument itself. Electric instruments, on the other hand, allow for a much greater variety of sounds. This is achieved by processing and subsequently augmenting and/or otherwise modifying electronically the sound produced by the instrument; the processed and modified sound can then be fed (or "broadcast") through an amplifier and loudspeaker, for example. In this way it is possible to add a wide variety of acoustic/audio effects to the music produced by the instrument.

Currently, if the sound of an acoustic instrument is to be modified electronically, an acoustic pickup must be used to encode the sound electronically before it can be processed and modified. The signal is then passed through electronic modules (e.g. guitar pedals, equalisers) before being broadcast through an amplifier and loudspeaker. Some amplifiers include electronics to modify the signal, so sometimes external modules are not necessary.

Many current solutions for modifying the sound of an instrument electronically and then playing it back (broadcasting it) are expensive; have a multitude of controls and require significant knowledge to operate; contain many parts, which require proper connection, are heavy and difficult to transport, and further require external electronic amplification, often needing an (external) power source.

It is desirable to have a method of adding, subtracting and modulating the sound vibrations of a musical instrument which is compact; light and portable; not dependent on an external power source; and simple and easy to use.

SUMMARY OF THE INVENTION

The present invention provides a novel accessory for musical instruments which alleviates some of the aforementioned problems.

According to the present invention, there is provided an accessory for modifying the sound output of a (preferably, stringed) musical instrument, the musical instrument comprising a body, in which the accessory comprises: an actuator for deforming the body of the musical instrument so as to modify the sound output of the musical instrument; and a fastener for engaging the accessory to the musical instrument.

In an alternative example, the accessory may be suitable for modifying and for engaging to any musical instrument, including for example any member of the percussion, wind, and brass families.

As used herein, the term "stringed musical instrument" preferably includes any sound-reproducing apparatus that generates sound by means of strings, as actuated by a user; for example, this may include any members of the guitar, violin and piano families.

Preferably, the musical instrument is an acoustic musical instrument, and more preferably the musical instrument is only an acoustic musical instrument (as opposed to an electric and/or electro-acoustic musical instrument).

Preferably, the musical instrument comprises a rigid body, wherein the body may have an acoustic function.

Preferably, the fastener is provided entirely (and only) as part of the accessory; that is, no modification of the musical instrument is needed and no further fastener need be provided in order to couple (fixedly) the accessory to the musical instrument. The fastener may instead be complementary to existing features of the musical instrument. Preferably, the fastener is a temporary fastener.

Preferably, the actuator is electromechanical, and for example a speaker driver. Preferably, the accessory comprises a battery for energising the actuator.

Preferably, for improved sound modification, the fastener is arranged (e.g. shaped and dimensioned) to locate the actuator proximate a sound hole of the musical instrument. Preferably, the actuator is sufficiently proximate so as to be at most 15 cm away, more preferably at most 10 cm away, still more preferably, 5 cm away, and yet more preferably at most 2.5 cm away.

Preferably, for improved sound modification, the fastener is arranged (e.g. shaped and dimensioned) to locate the actuator proximate the string(s) of the musical instrument.

Preferably, for ease of access, the fastener is arranged (e.g. shaped and dimensioned) so as to locate the actuator on an external surface of the musical instrument. Preferably, the fastener is arranged so as to locate the actuator on the front face of the musical instrument. As used herein, the term "front", when referring to a musical instrument, preferably connotes a side or part of the musical instrument on which the strings of the musical instrument are provided or on which the inputs are provided for a user to play the musical instrument.

Preferably, for improved sound modification, the fastener is arranged (e.g. shaped and dimensioned) so as to locate the actuator on a soundboard of the musical instrument.

Preferably, for improved sound modification, the fastener is arranged (e.g. shaped and dimensioned) so as locate the actuator (directly) between the bridge or saddle and the strap pin or endpin.

Preferably, for reduced feedback, the fastener is arranged so as to locate the actuator closer to the bridge or saddle than to the strap pin on endpin, and more preferably at least around three-quarters of the way to the bridge or saddle from the strap pin or endpin.

Optionally, the fastener comprises a securing formation for engaging the accessory to the bridge or saddle or of the musical instrument. The fastener (in particular the securing formation) may be arranged to couple to the bridge, the saddle and/or the bridge pin. The fastener (in particular the securing formation) may consist of or comprises a (recessed or indented) hook, claw or a clamp.

Preferably, the fastener is arranged to engage with the sound hole. The fastener may comprise a tether.

Preferably, the fastener comprises a securing member for engaging the accessory to a strap pin or an endpin of the musical instrument. The fastener may consist (in particular the securing member) of or comprise a loop, screw or clamp. Preferably, the fastener is, at least in part, formed from an elastic material.

Preferably, the securing member (and, preferably, only the securing member) is formed from an elastic material. In this way, the accessory may be coupled firmly to the musical instrument by means, at least, of tension.

Preferably, the fastener is adjustable, thereby to allow the accessory to be retrofit onto musical instruments having different shapes and/or dimensions.

Preferably, the accessory further comprises a housing within which the actuator is housed. Preferably, the actuator protrudes from the housing. Preferably, the housing tapers towards the surface of the musical instrument in the direction that it approaches the bridge, saddle or string(s).

Preferably, the fastener is integral with the housing.

Preferably, the accessory further comprises a sound sensor for sensing the sound output of the musical instrument. The sound sensor may be a microphone, for example a contact (piezo-electric-based) microphone.

Preferably, the sound sensor is integral with/built into the accessory. Preferably, the accessory (in particular, a controller) is pre-calibrated to the sound sensor. Preferably, the sound sensor is not formed as part of the musical instrument nor is the sound sensor a separate/stand-alone sound sensor (or "pickup"). Preferably, the sound sensor is integral with or fixed to the fastener.

Preferably, the sound sensor is housed in a housing that is coupled to the fastener (or securing member). Preferably, the housing is rigid. Preferably, the housing forms part of the fastener (or securing member). Preferably, the housing comprises a socket or a locating formation for receiving the strap pin or an endpin.

Preferably, the sound sensor is arranged distally to the actuator. In this way, feedback between the actuator and sound sensor may be reduced.

Preferably, in use, the sound sensor and the actuator are arranged on different faces of the musical instrument.

Preferably, the actuator is a piston. Preferably, the actuator comprises a face that is substantially circular or annular in shape. Preferably, the face of the actuator is flat.

Preferably, the fastener is a conduit for an electrical connector connecting (e.g. indirectly) the sound sensor and the actuator.

Preferably, the accessory further comprises a switch for deactivating (preferably, 5 only) the sound sensor.

Preferably, the accessory further comprises a controller for controlling the actuator.

Preferably, the controller is configured to control the actuator in dependence on the sound sensed by the sound sensor.

Preferably, the controller is configured to control the actuator so as to modify the sound output of the musical instrument thereby to effect: a delay effect; a reverberation effect; a distortion effect; quietening and/or loudening; and/or a noise gating effect.

Preferably, the controller is configured to induce a delay to the actuation of the actuator. The delay may be dependent on the sound sensed by the sound sensor. Preferably, the induced delay is between 0.5 milliseconds (ms) and 10 ms, more preferably the delay is between 2 ms and 8 ms, and still more preferably the delay is between 4 ms and 6 ms.

Preferably, the controller is configured to filter feedback between the actuator and sound sensor, for example by means of signal processing.

Preferably, the controller is configurable to control the actuator independently of the sound sensed by the sound sensor. Preferably, the controller is user configurable.

Preferably, the accessory further comprises a user input, wherein, in use, the user input is arranged at the front of the musical instrument.

Preferably, the user input is arranged proximate to the bridge or saddle of the musical instrument, such that the user input may be actuated (e.g. depressed) by a user whilst playing the musical instrument without substantially affecting the way in which the user plays the musical instrument.

Preferably, the user input is an input for modifying the operation of the accessory, in particular to activate/deactivate the accessory and/or to modify the combination and/or magnitude of each effect. Preferably, a user input is provided for each audio effect that the accessory is configured to effect. Preferably, the user input (for each audio effect) is in the form of a slider, optionally incorporating a potentiometer.

Preferably, in use, the user input is inclined towards the user, and more preferably the user input is inclined so as to face the hand of a user when playing the instrument.

Preferably, the actuator comprises a damping member for contacting the surface of the musical instrument. Preferably, the damping member is formed of a deformable material, for example, rubber, plastic or silicone.

Preferably, the accessory further comprises an electric port for inputting or outputting an audio signal. The electric port may receive an audio signal for processing by the controller so as to control the actuator in dependence on the audio signal, for example to output the audio signal. The electric port may output an acoustic signal, for example the acoustic signal sensed by the sound sensor.

Preferably, the accessory further comprises a hinged muting member for contacting the string(s) so as to effect/simulate a palm mute. Preferably, the muting member is arranged to contact the strings at a point proximate, and more preferably nearest, the bridge or saddle. Preferably, the muting member is urged away from the string(s).

According to another aspect of the invention, there is provided a musical instrument comprising the aforementioned accessory.

The accessory may function on the premise of a vibration pickup and a vibration speaker driver—used in concert with control electronics and software—to add to, subtract from, and modulate the acoustic vibrations producing sound.

The invention extends to any novel aspects or features described and/or illustrated herein. Further features of the invention are characterised by the other independent and dependent claims.

Any feature in one aspect of the invention may be applied to other aspects of the invention, in any appropriate combination. In particular, method aspects may be applied to apparatus aspects, and vice versa.

Furthermore, feature implemented in hardware may be implemented in software, and vice versa. Any reference to software and hardware feature herein should be construed accordingly.

Any apparatus feature as described herein may also be provided as a method feature, and vice versa. As used herein, means plus function features may be expressed alternatively in terms of their corresponding structure, such as a 20 suitably programmed processor and associated memory.

It should also be appreciated that particular combinations of the various features described and defined in any aspects of the invention can be implemented and/or supplied and/or used independently.

The invention also provides a computer program and a computer program product comprising software code adapted, when executed on a data processing apparatus, to perform and of the methods described herein, including any or all of their component steps.

The invention also provides a computer program and a computer program product comprising software code which, when executed on a data processing apparatus, comprises any of the apparatus features described herein.

The invention also provides a computer program and a computer program product having an operating system which supports a computer program for carrying out any of the methods described herein and/or for embodying any of the apparatus features described herein.

The invention also provides a computer readable medium having stored thereon the computer program as aforesaid.

The invention also provides a signal carrying the computer program as aforesaid, and a method of transmitting such a signal.

The invention extends to methods and/or apparatus substantially as herein described with reference to the accompanying drawings.

The accessory (also equivalently referred to as the device) comprises a sound sensor, an actuator, and a controller for controlling the actuator. The sound sensor and/or the actuator may be in contact with the body of the instrument (e.g. on an external surface of the musical instrument).

The sound output of the instrument is sensed by the sound sensor and transmitted to the controller, which processes the sound sensed by the sound sensor and controls the actuator in dependence on the sound sensed by the sound sensor. The actuator serves to add to, subtract from, modulate and/or otherwise modify the sound output of the instrument by deforming the body of the musical instrument.

The device is coupled to an instrument by means of a fastener. The fastener may be provided entirely as part of the device. The actuator is positioned so as to be in contact with (or to be able to contact) the instrument body. The actuator vibrates and deforms the body to modify the sound output of the musical instrument. The device uses wave interference and superposition to produce a desired sound by adding the difference between the desired sound and the sound that is sensed by the sound sensor.

The device may be used to modify the sound output of a multitude of musical instruments. In the following, the device is described in the context of an acoustic guitar, but it will be appreciated that is can be applied to myriad instruments including but not limited to stringed, percussion and wind instruments.

The device may provide the capability to:

- Add effects such as delay, distortion, reverb and/or tremolo to the sound output of the instrument;
- Add backing music/sounds (e.g. drums) to the sound output of the instrument, and synchronize the backing music to the speed of the music being played; and/or
- Remove certain sounds and/or frequencies from the sound output of the instrument, using destructive interference.

Effects are added by the controller which comprises electronic circuitry and/or software. The controller analyses and modifies the signals (i.e. waveforms) received from the sound sensor before transmitting the modified waveforms to the actuator. The behaviour of the controller may be controlled by user controls on the device. The user controls may be one or more sliders, for example, that allow the variation of the intensity of the different effects produced by the controller and actuator.

BRIEF DESCRIPTION OF THE DRAWINGS

The invention will now be described by way of an example, with reference to the accompanying drawings in which.

DETAILED DESCRIPTION OF THE INVENTION

Figure 1:
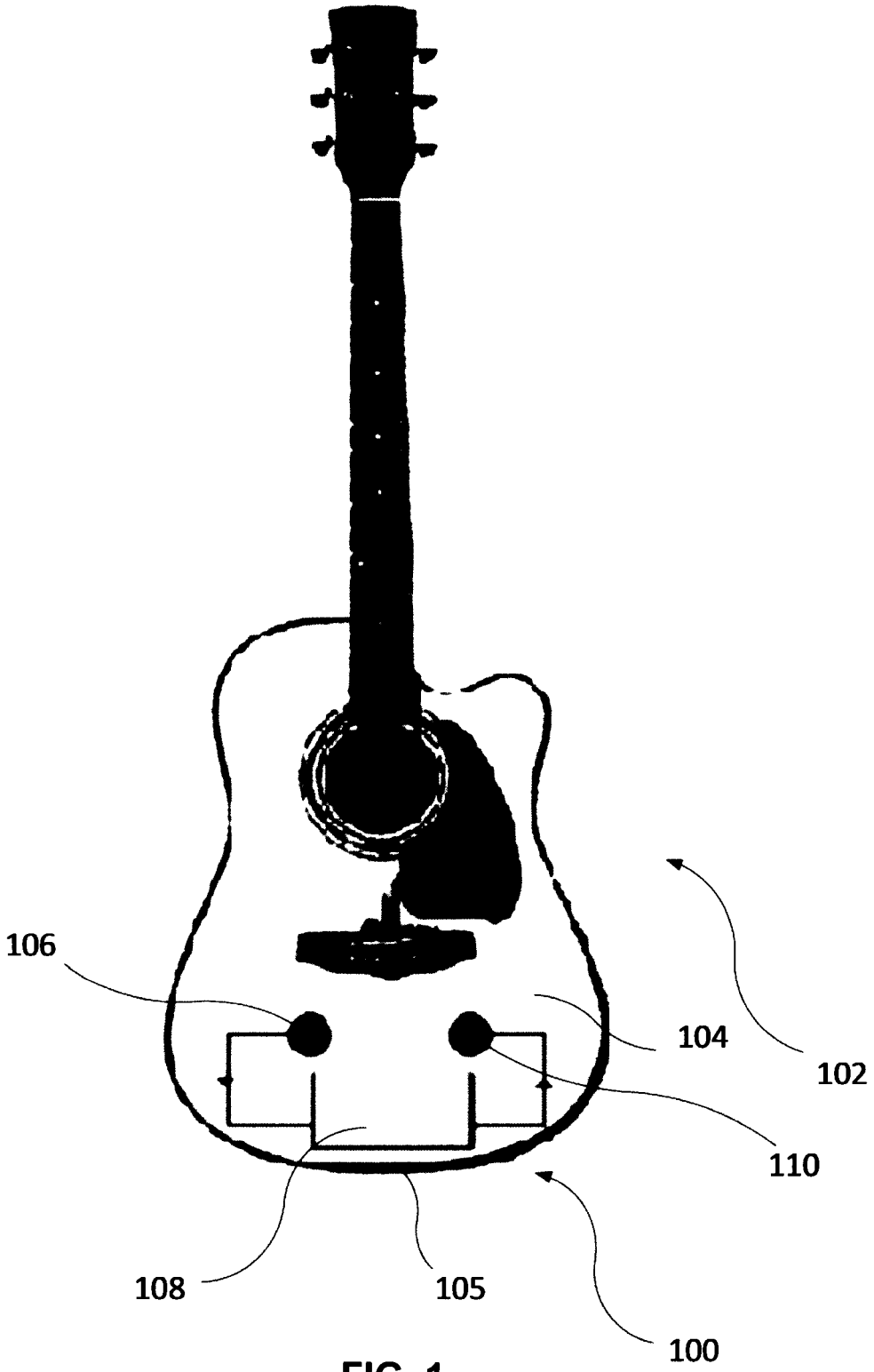
FIG. 1 shows a schematic illustration of the hardware of the accessory, in situ on an acoustic guitar.

FIG. 1 shows a schematic illustration of the hardware of the accessory, illustrated in situ on an acoustic guitar.

The device 100 is attached to an instrument (e.g. an acoustic guitar) 102. The device 100 comprises a sound sensor 106 that is capable of sensing the sound output from the guitar 102 when the guitar 102 is played. The sound sensor 106 (which can also be referred to as a vibration pickup) can be placed in various places on the guitar 102. Particularly advantageous locations for the sound sensor 106 include the upper surface 104 of the body of the instrument (the soundboard) and the centre of the base of the guitar 105. The sound sensor 106 is preferably a piezoelectric pickup. In an alternative, the sound sensor 106 can be a microphone, or any magnetic, optical, and/or piezoelectric pickup operable to capture the sound of the instrument 102. The sound sensor 106 converts the sound produced by the instrument 102 to an analogue electronic signal.

The device 100 further comprises a controller 108. The controller comprises electronic circuitry to process the signals produced by, and received from, the sound sensor 106. The electronic circuitry in the controller 108 may incorporate an analogue to digital converter operable to digitise the signal provided by the sound sensor 106. In an alternative, the signal is digitised by the sound sensor 106.

The electronic circuitry of the controller 108 is operable to analyse the signal received from the sound sensor 106 and to add effects to said signal. For example, the electronic circuitry may augment and/or otherwise modify the signal received from the sound sensor 106 by adding distortion, delay, reverb, tremolo, vibrato and/or other effects to the signal. In order to achieve this, the electronic circuitry of the controller 108 analyses and modifies the signal (i.e. waveform) received from the sound sensor 106. Distortion is produced by clipping the crests and troughs in the signal waveforms received from the sound sensor 106. Delay is produced by copying a section of the waveform received from the sound sensor 106 and adding it to the transmitted waveform a while later. Tremolo may be produced by varying the amplitude of the received waveform. Vibrato may be produced by varying the frequency of the received waveform. The waveforms processed and modified and/or otherwise augmented with effects by the electronic circuitry of the controller 108 are then transmitted to the actuator 110 (also referred to the vibration speaker). The controller 108 can produce distortion effects particularly effectively.

The electronic circuitry of the controller 108 may further comprise a processor operable to execute software to process and/or modify the signal received from the sound sensor 106. The software may be pre-loaded onto the electronic componentry and/or may be programmed by the user.

The processed and augmented and/or otherwise modified signal produced by the electronic circuitry of the controller 108 is then passed to the actuator 110. The actuator 110 receives the processed signals from the controller 108 and generates vibrations from the waveforms. In this way, the controller 108 controls the actuator 110. The actuator 110 is situated in contact with the body of the instrument (for example, the upper surface 104 of the body).

The actuator 110 outputs the signals received from the controller 108 in the form of vibrations (or sound); i.e. it converts the signals to vibrations or sound, so the actuator 110 is a form of vibration speaker. The actuator 110, being in contact with the upper surface 104 of the body of the instrument 102, causes the body of the instrument to vibrate and produce sound and/or otherwise modify the sound produced by the instrument 102. In this way, the upper surface 104 of the body of the instrument 102 (and/or the body of the instrument as a whole) acts like the diaphragm of a speaker. By producing sound in this way, the device 100 modifies (or augments) the sound of the instrument 102, optionally in dependence on the sound sensed by the sound sensor 106.

The augmented sound is a combination of that directly produced by the strings of the instrument 102 itself, and that produced by the actuator 110 vibrating the body of the instrument. The augmented sound thus produced will then itself be picked up by the sound sensor 106, be passed through the electronic circuitry of the controller 108, and be passed to the actuator 110. This results in an inherent feedback loop whose effects should be understood and controlled. It is an object of the present invention to control and/or limit feedback effects particularly effectively.

The string pegs (or bridge pins) 312 of the guitar 102 are situated on the bridge 310 of the guitar 102 and protrude from the surface of the bridge 310. In the embodiment illustrated in FIG. 8, the device 800 engages with the string pegs 812 by means of an indentation 211, 811.

Figure 2:
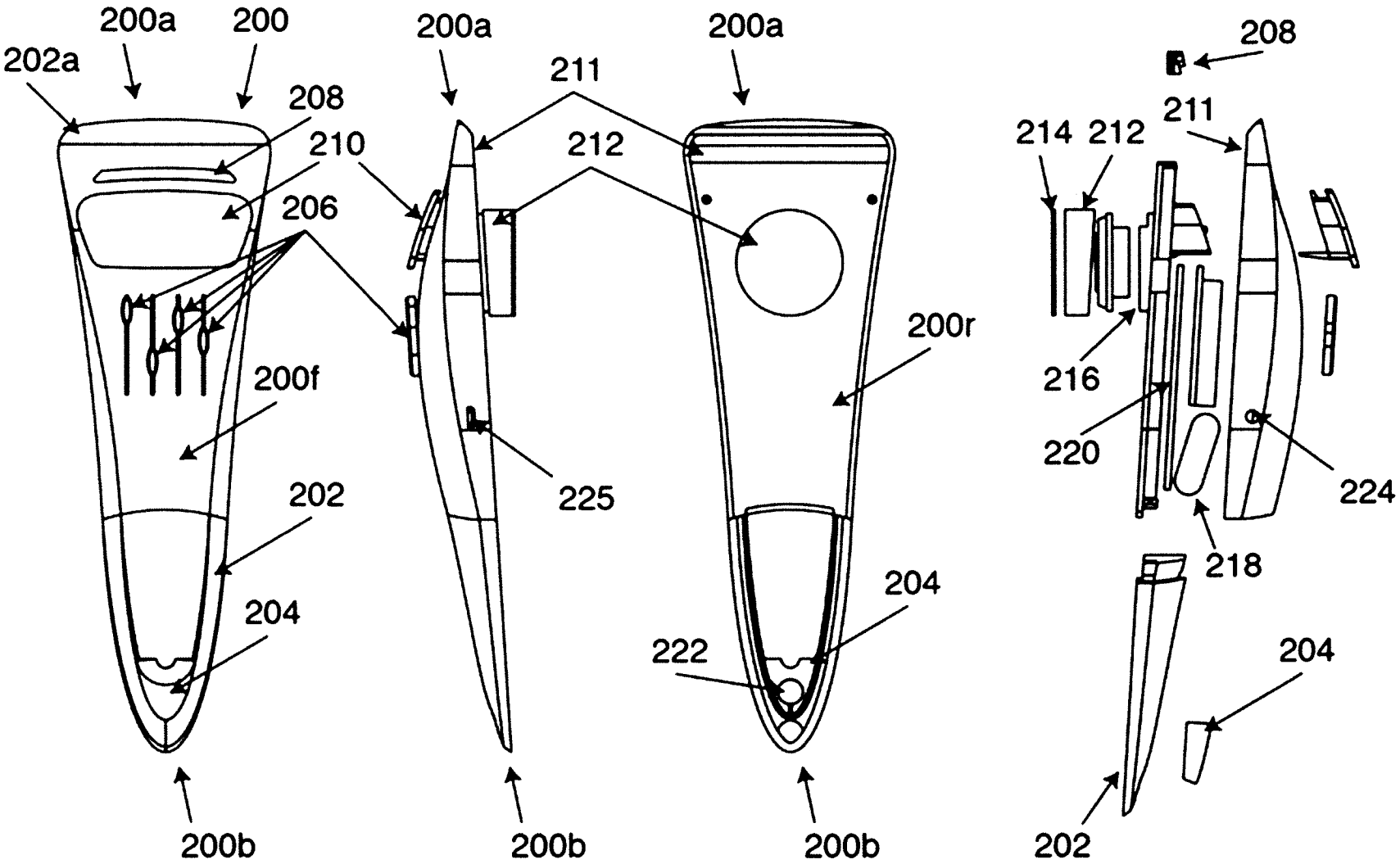
FIG. 2 shows an embodiment of the accessory from several angles.

FIG. 2 shows an embodiment of the device of the present invention, from different angles, including an exploded view.

The device 200 has an elongate shape, with an upper portion 200*a*; a lower portion 200*b*; a front face 200*f*; and a rear face 200*r*. The thickness of the device (between the front face 200*f* and the rear face 200*r*) is smallest at the extremities of the upper and lower portions 200*a* and 200*b* (i.e. it is tapered towards the upper and lower extremities), and is at a maximum in the upper portion 200*a* of the device, approximately a third of the way along its length from the upper portion 200*a* to the lower portion 200*b*. The width of the device 200 (in the lateral direction, perpendicular to its thickness) is also tapered so that it decreases from the upper portion 200*a* to the lower portion 200*b*.

The upper portion 200*a* is made primarily of moulded plastic. The lower portion 200*b* comprises an elastic strap 202 (or tether) which is attached to opposing sides of the lower part of the upper portion 200*a*. The elastic strap is made from polyurethane. The upper portion comprises a shell top (forming the front face 200*f*) and a shell bottom (forming the rear face 200*r*). The lower portion of the strap 202 comprises an inwardly protruding central portion 204. The inwardly protruding central portion 204 is an enclosure for the piezoelectric sensor. The inwardly protruding central portion 204 comprises a semi-circular indentation that acts as a hook for attaching the strap 202 (and the device 200) to the strap pin (equivalently referred to as a strap button) at the base of a guitar, in use. The rear side of the inwardly protruding central portion 204 houses the sound sensor 222 (or vibration pickup). In use, the elastic strap is fixed to the strap button on the base of the guitar by means of the hook 204, such that the vibration pickup 222 is also situated at the base of the guitar, close to the strap button. In this way, the elastic strap 202 has the role of a fastener for engaging the device or accessory to the instrument.

On its front side 200*f*, the device 200 as depicted in FIG. 2 comprises four sliders 206 that can be used to control the sound effects produced by the device 200. The sliders are potentiometers that allow for the effects to be varied through the variation of a resistance in the electronic circuitry of the controller. For example, one slider may control the rate of the delay effect, another slider the length of the delay, another slider the distortion amount, another slider the amount of reverb, and another slider the duration of the reverb. In an alternative, there may be fewer or more sliders than four (see for example FIGS. 4*a* and 4*b*). The effects may be provided independently and/or in any combination and in any amount. The sliders 206, 314, 404 are made from die-cast metal such as zinc. In an alternative, the sliders 206, 314, 404 may be made from any suitable material such as a plastic.

The device 200 further comprises on its front side 200*f* an LED indicator 208 situated around the upper portion 200*a* of the device 200. The LED indicator 208 may comprise a light pipe made from polycarbonate material. The LED indicator 208 is operable to indicate the status of the device 200 to a user—for example, by being illuminated when the device 200 is powered and/or in operation. In an alternative, the LED 208 is replaced by another type of light source.

The device 200 comprises on its front side 200*f* a pad 210 situated in the upper portion 200*a* of the device 200. For convenience, the pad 210 spans almost the whole width of the device 200. The design and position of the pad 210 is such that it is easily reached and actuated by the palm of a user when the device 200 is in use. The pad 210 acts as a button that allows the user to turn the device 200 off and on.

Figure 3:
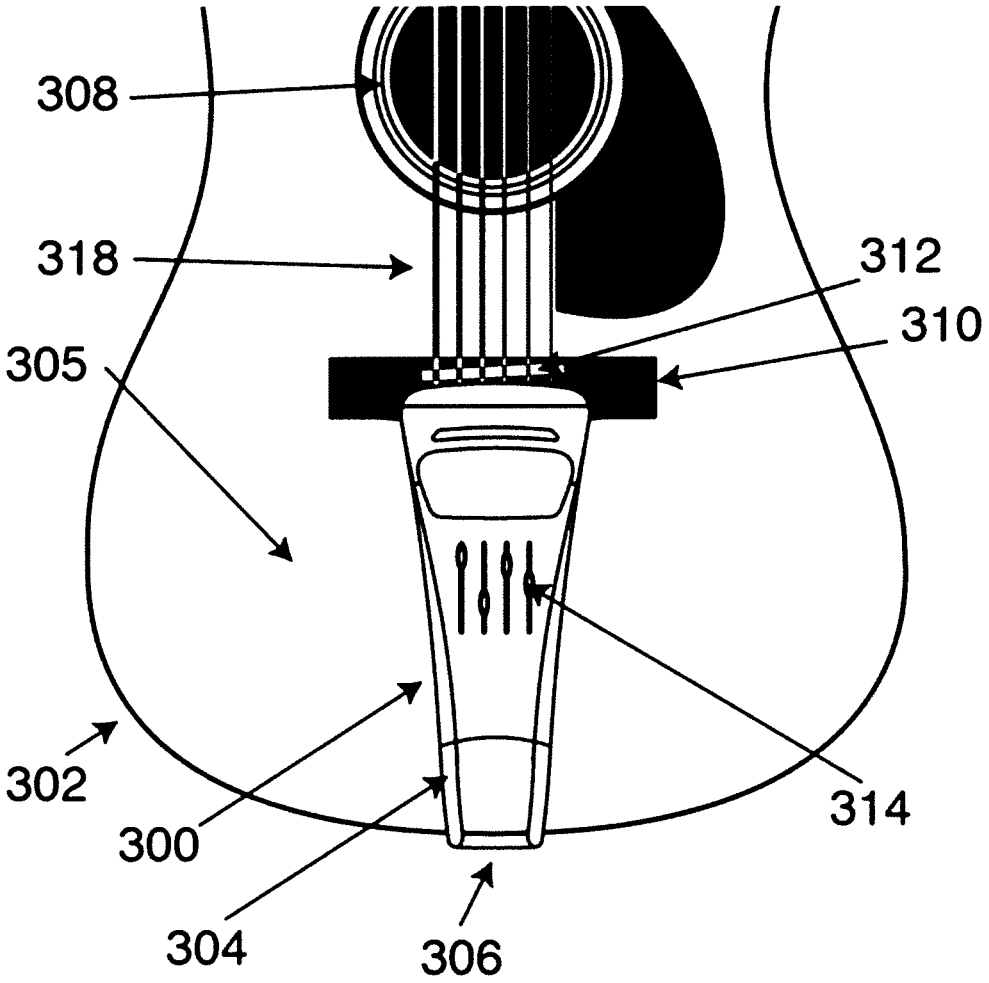
FIG. 3 shows the accessory coupled to an acoustic guitar.

The pad 210 can be actuated by the user whilst they are using the instrument to which the device is fixed (see FIG. 3). The LED 208 indicates whether the device 200 is off or on. In an alternative, the palm pad 210 is not provided integrally with the device 200 but is provided as a separate accessory.

The device 200 is primarily planar on its rear side 200*r*, apart from an indentation 211, 811 and the (protruding) actuator 212.

The indentation 211, 811 is elongate in the direction of the width of the device 200. The indentation 211, 811 effectively forms a hook and serves to receive the string pegs (or bridge pins) which fasten the strings of the instrument to the bridge (see FIG. 8). Along with the hook portion 204 of elastic strap 202 attached to the strap button, placing the device on an instrument so that the indentation 211, 811 receives the string pegs 812 fastens the device 200 to the instrument, (at least) by the tension of the elastic strap 202.

The actuator 212 is cylindrical in shape, or at least has a circular or annular base. The actuator 212 has the shape of a piston. In situ on a musical instrument, the axis of (actuation of) the cylinder is perpendicular to the soundboard of the musical instrument. The actuator 212 stands proud of the rear 200*r* of the device 200 and is arranged to be in contact with the body of the instrument to which the device is fixed, in use. The actuator 212 vibrates in use in the direction of its axis (perpendicular to the soundboard), and in turn makes the body of the instrument vibrate to produce sounds. The actuator 212 further comprises a pad 214 which separates the body of the actuator 212 from the body of the instrument. The pad 214 prevents the actuator chattering against the body of the instrument, in use.

The pad 214 may be made from polyurethane. The actuator 212 is fixed to the body 202*a* of the device 200 via an actuator housing 216. The actuator preferably has a power of between 5 and 10 watts, and impedance of 8 Ohms, a distortion of less than 5%, and a frequency range of 20 kHz.

The interior of the device 200 comprises a lithium ion battery 218 and a PCB 220 for the electronic circuitry. The lithium ion battery 218 may have a capacity of 1100 mAh. In an alternative, the lithium ion battery 218 may be replaced with a cell, for example an AA cell.

The device further comprises an electric input/output port 224 for attaching external components, for the purposes of recording the sound of the musical instrument (whether augmented with effects or not) and/or for inputting backing music to be output by the device, for example.

The device further comprises an electric input port 225 for charging of the battery and/or for updating the device's software.

FIG. 3 is an illustration of an embodiment of the device 300 of the current invention, in use on an acoustic guitar 302.

The device 300 is attached to the guitar 302 by means of the elastic strap 304 which terminates in the hook that is attached to the strap button of the guitar situated at the base of the guitar 306, and by means of the indentation on the rear side of the device 300 which engages with the string pegs (which anchor the strings 318 of the guitar on the bridge 310 just below the saddle 312). The device 300 is thus securely fixed to the guitar 302 (by the tension of the elastic strap 304, at least) but may also be easily removed. Thus the device 300 does not have to be permanently fixed to the guitar 302.

The actuator situated on the rear side of the device 300 is in contact with the upper surface 305 of the body of the guitar (the soundboard). Due to the fastener of the device 300 which is elastic and designed to be hooked onto the musical instrument, the device 300 is removably attached to the guitar 302. The actuator is positioned in the middle of the upper surface 305 of the body of the guitar (also referred to as the soundboard), between the bridge 310 and the base 306 of the guitar, slightly closer to the bridge 310 than the base 306. The actuation point is situated in the region far away from the edges of the upper surface 305 (where it meets the sides of the body 302)—in this region the maximum displacement of the upper surface 305 is possible when the upper surface 305 is actuated by the actuator. This allows the actuator to be as effective as possible in vibrating the body 302 of the instrument and therefore in creating sound. Actuation in the middle of the soundboard 305 is more effective than actuation on the rear surface of the body 302 of the guitar, for example.

As shown in FIG. 2, the end of the elastic strap houses the sound sensor (or vibration pickup) 222. In use, with the device 300 attached to the guitar 302 as shown, the sound sensor is situated at the base of the guitar 306, close to the strap button. Therefore due to the shape, arrangement, and dimensions of the device 300 and in particular the strap 304 and the area 306 where the strap 304 is attached to the body 302 of the guitar, the sound sensor is positioned to pick up the sound (or vibrations) of the instrument in a location where the signals can be most effectively received by the sound sensor. For example, the relative position of the actuator and sound sensor is advantageous in allowing the minimisation of feedback between the actuator and the sound sensor.

The sliders 314 allow the variation of the sound effects produced by the device 300 and can be seen on the top of the device 300. In an alternative, there may be fewer or more sliders (see FIGS. 4*a* and 4*b* for example).

The strings 318 are fixed to the bridge 310 by the bridge pins (under the upper portion of the device 300) and extend towards the opening 308 (sound hole) in the chamber, past the saddle 312, which they contact. In use, the strings 318 are actuated (by hand, for example). Actuating the strings 318 causes them to vibrate and produce sound. The sound may enter the body of the instrument via the bridge 310 and cause the body of the instrument, including the upper surface 305 of the body (the soundboard), to vibrate. The vibration of the body of the instrument produces sound in addition to that created directly by the vibrating strings 318. In particular, the body of the instrument can amplify and/or enhance the sound produced by the strings 318. The vibrations of the body 302 produced in this way are sensed by the sound sensor.

Figure 4A:
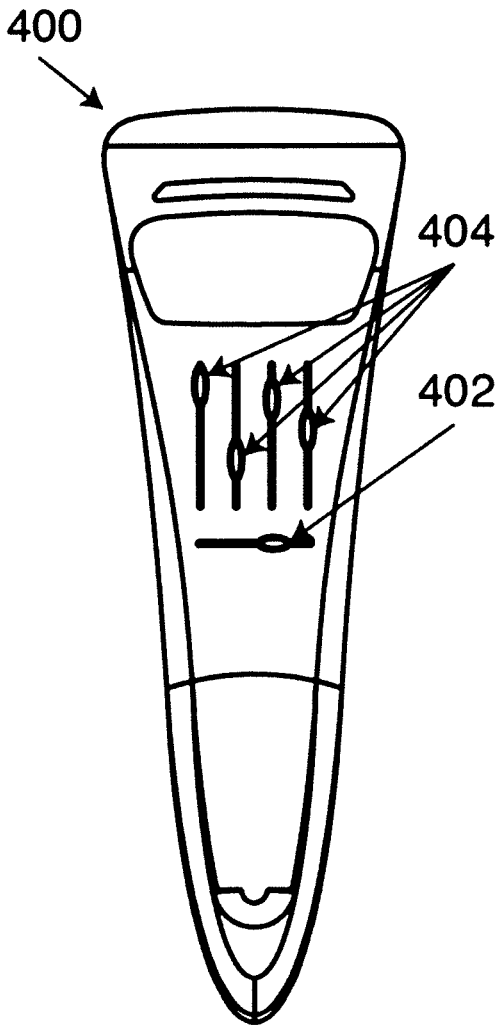
FIGS. 4*a* and 4*b* show alternative versions of the device with different numbers of sliders and in different configurations.

FIG. 4*a* shows an alternative version of the device 400 with a (lateral) slider 402 in addition to the four longitudinal sliders 404. The lateral slider can control an additional sound effect or the volume of the sound effects, for example.

Figure 4B:
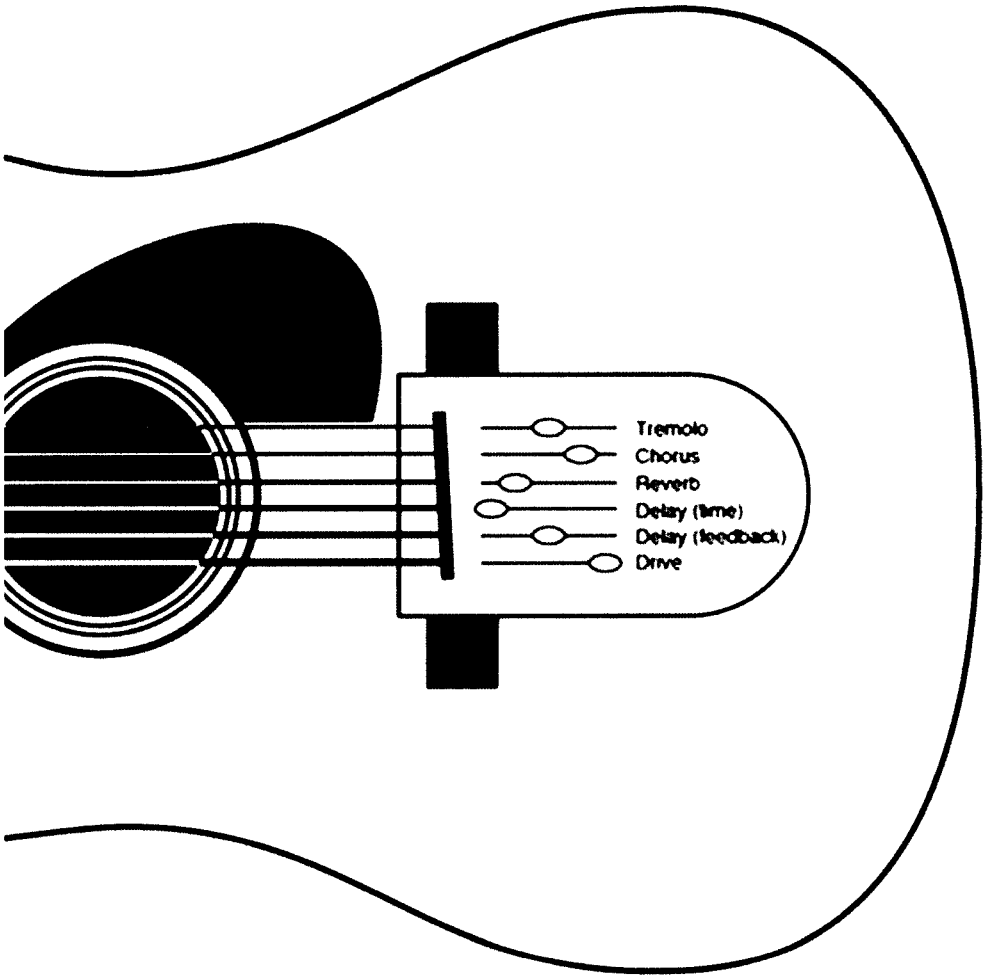

FIG. 4*b* shows yet another version of the device with six sliders, one for tremolo, one for chorus, one for reverb, one for the time of the delay, one for the fade of the delay, and one for drive (i.e. overdrive, equivalent to distortion).

Figure 5:
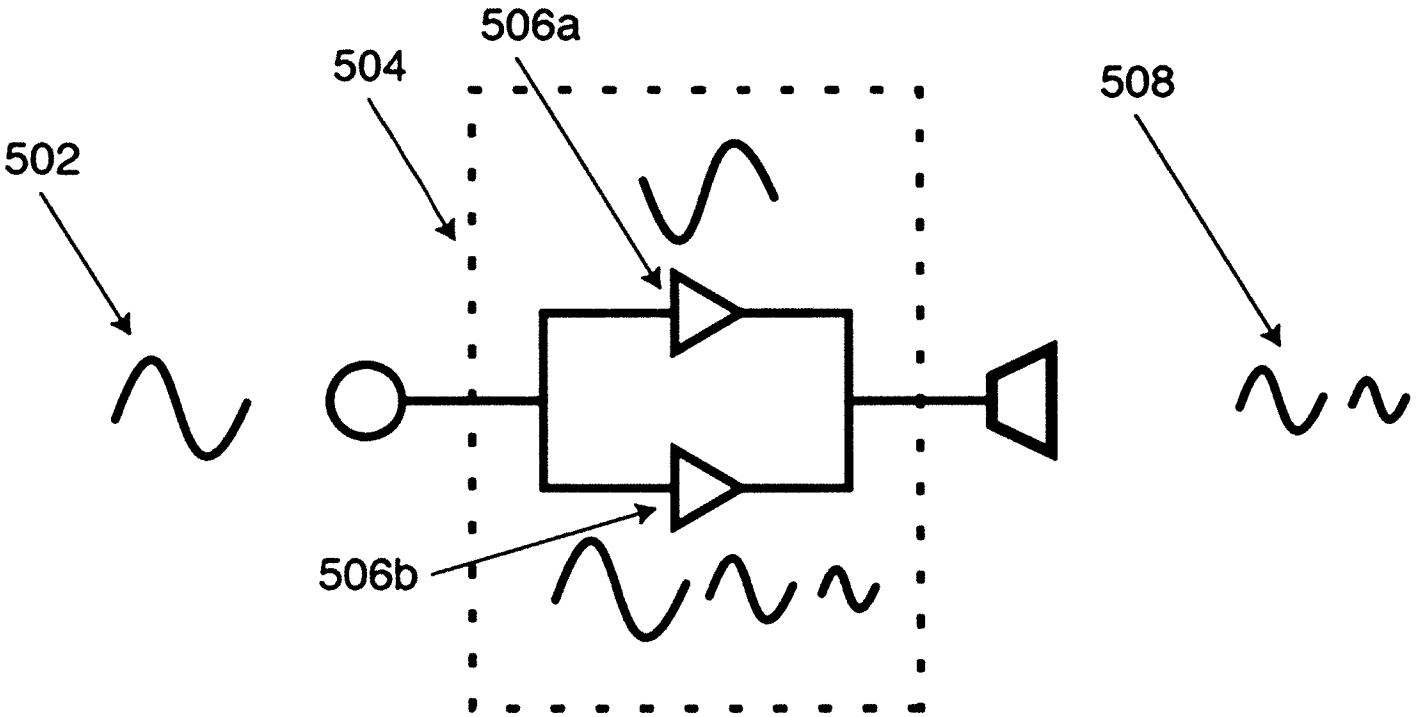
FIG. 5 shows a schematic diagram of part of the signal processing.

FIG. 5 shows a schematic diagram of part of the signal processing provided by the electronic circuitry. The sound sensor transmits the original signal 502 to an element of the electronic circuitry 504 which comprises signal processing elements 506*a* and 506*b*. The original signal 502 enters, and is split into two separate processes. Processing element 506*a* inverts (takes the negative of) the signal 502, and processing element 506*b* processes the signal into a signal corresponding to the user's desired sound. When the signals are recombined, the signal from 506*a* acts to cancel the original signal from 506*b* and the output signal 508 of the software (or circuitry) is just the portion of the signal with the desired audio effect. Since the original signal 502 is already in the body of the guitar, when the outputted signal 508 is inputted into the body of the guitar by the actuator, the user hears signal 506*b*. The diagram shows the signal processing in the case of the delay effect as an example—the output signal 508 shows two repeats, but not the original signal 502. The same principle applies to the other audio effects (such as distortion and reverb, for example).

Figure 6:
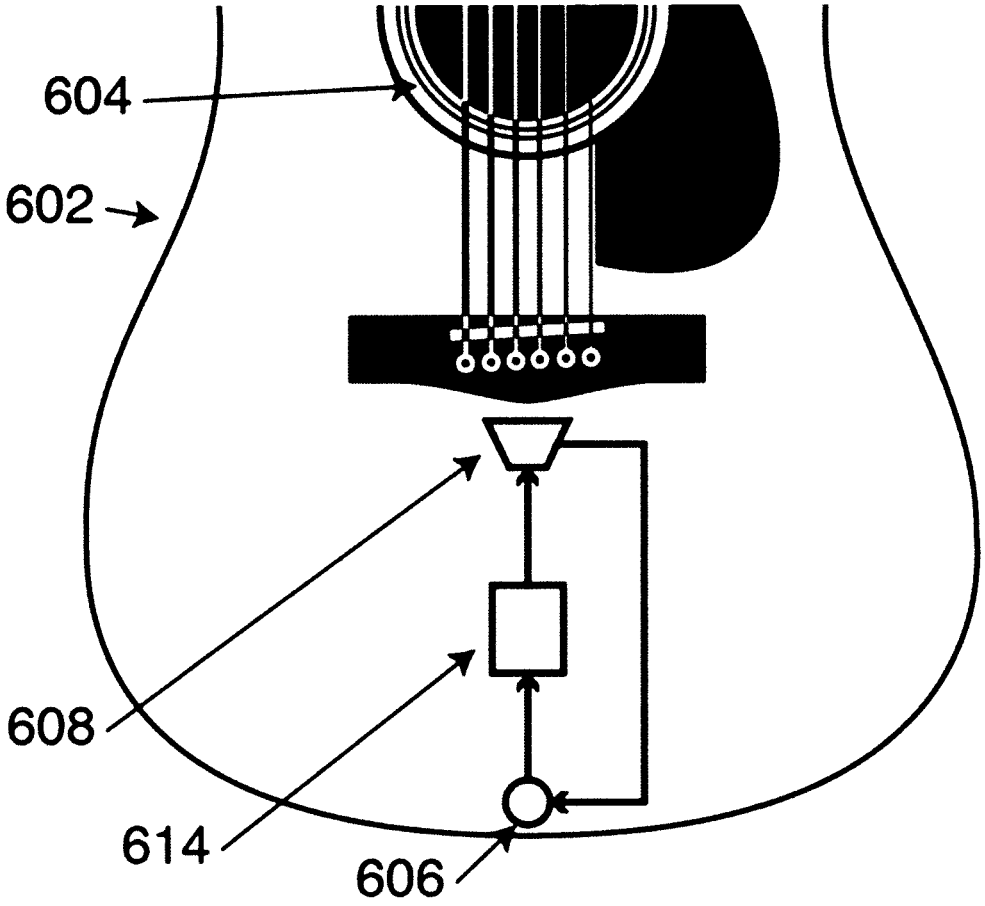
FIG. 6 shows the component layout of the device in situ on a guitar.

FIG. 6 shows the component layout of the device on a guitar 602 with sound hole 604. The components comprise an input 606, a transducer 608, and a digital signal processing (DSP) module 614.

Figure 7:
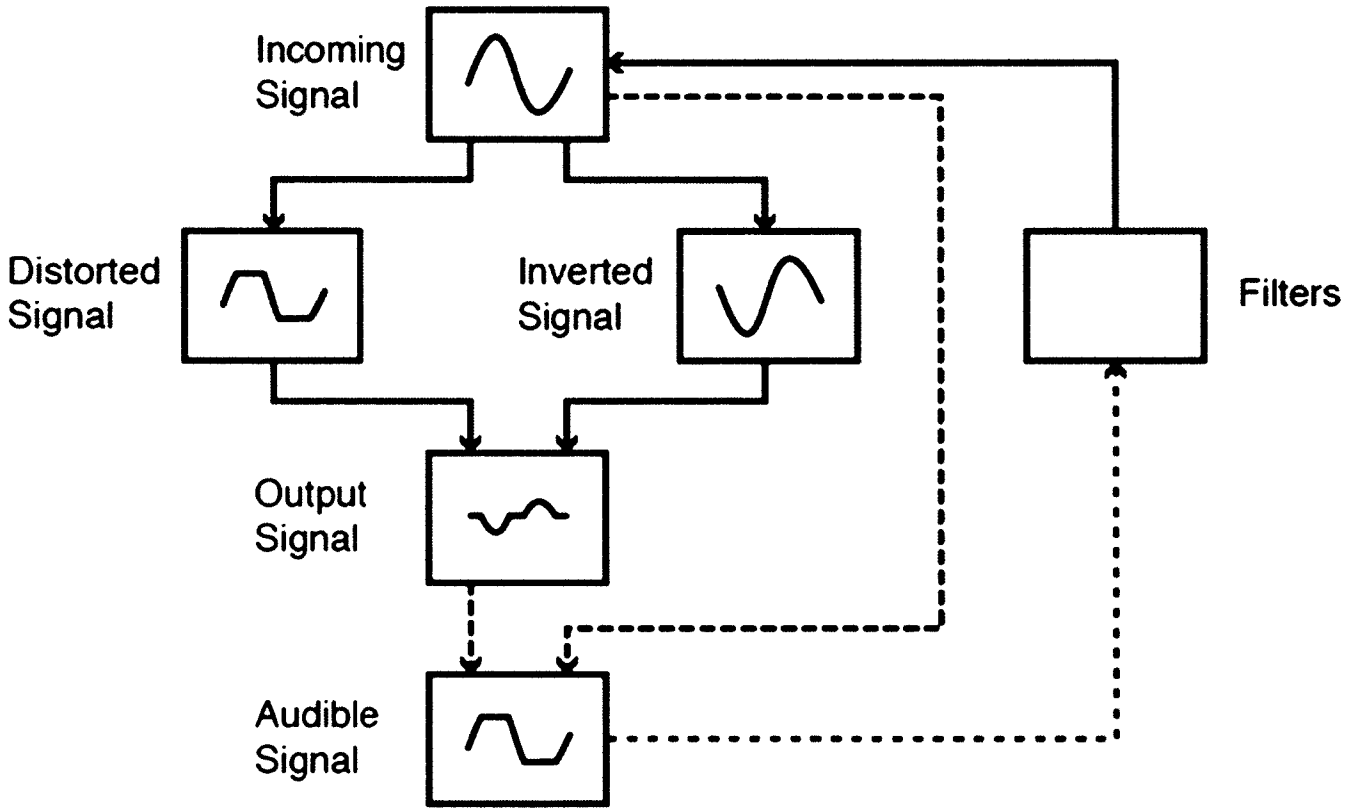
FIG. 7 shows a flowchart detailing the signal processing provided by the electronic circuitry of the device.

FIG. 7 shows a flowchart detailing the signal processing provided by the electronic circuitry of the controller, with the distortion effect used as an example. Electronic signal flows are shown by solid lines, and signal flows occurring within the vibrations of the body of the guitar are shown by dashed lines. The original signal is split and processed separately, applying the distortion to one path, and inverting (taking the negative of) the other path. The signals are then recombined such that the output signal is the difference between the original signal and the distorted signal. The output signal then combines with the vibrations already existing within the body of the guitar to create the audible distorted signal. Once the sensor or microphone picks up the sound, it is filtered to bring the signal back to the sound that the guitar would be producing were it not being modified by the device.

Figure 8:
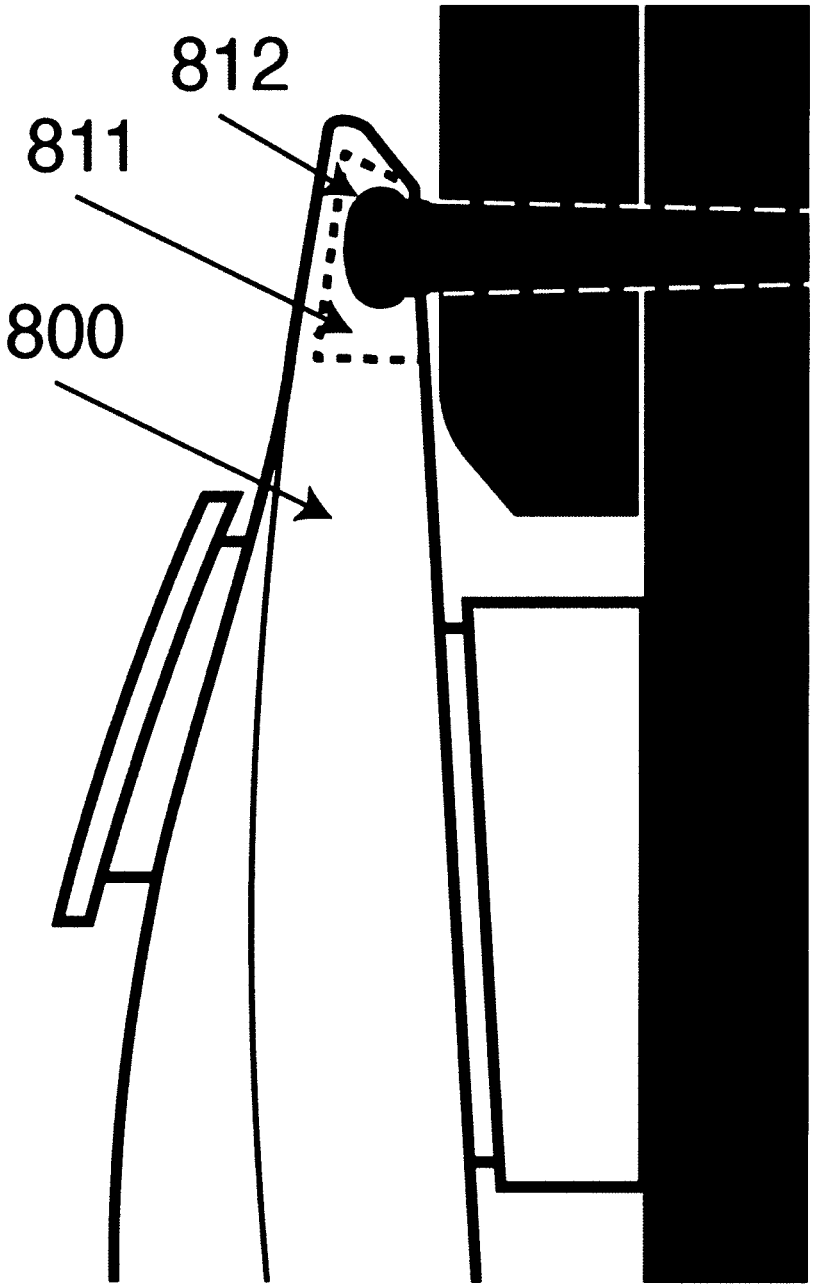
FIG. 8 shows a detailed diagram of the attachment mechanism at the bridge of the guitar.

FIG. 8 shows an illustration of the attachment mechanism to the bridge of the guitar. Indentation 811 forms a hook, which holds on to string peg 812, using tension from the device's strap.

Variations and Alternatives

Multiple variations on the accessory may be envisaged in order to accommodate a range of musical instruments. Variations can be accommodated by a single form of the invention due to the adjustable or elastic fastener. A variation of the device can be provided for substantially different musical instruments.

The device may contain a battery and charging circuitry in order to be self-powered, but may also be connected to a mains outlet depending on the application.

The device may comprise an input and/or output jack. The input and/or output jack may allow the augmented sound of the instrument to be outputted and recorded, for example. The input and/or output jack may allow for an external signal (embodying a backing track, for example) to be inputted and converted to vibrations or sound by the actuator (i.e. vibration speaker) without being processed by the electronic circuitry.

The device may have a particularly simple user interface. The user interface may present the user with information related to the operation and/or status of the device. The user interface may also allow the user to control the device. The user interface may comprise sliders as illustrated in FIGS. 2 and 3 to vary the effects introduced into the sound by the controller and the magnitude and/or other properties of the effects, such as duration. The user interface may further comprise a display. The display may be a touchscreen display that allows the device to be controlled, including the effects, for example.

The device may provide for particularly effective feedback cancellation which is made possible inter alia by the absolute and relative positioning of the sound sensor and actuator. Feedback may also be minimised due to the sound sensor being an integral part of the device and having known characteristics, for example. In applications where the sound sensor and actuator are not in use together, or are not interacting, the soundboard is the ideal location to position them, as the soundboard is designed as the optimal resonance surface for the instrument. However, in this application, the sound sensor and actuator interact with one another, causing feedback. Positioning of the sound sensor as far as possible from the actuator ensures that as little feedback is introduced into the system as possible, similar to how a microphone must be positioned as far as possible from a speaker in order to reduce feedback. As the actuator produces an audible sound directly, the sound it produces is not able to be processed. In contrast, the sound sensor produces an electronic signal, which can be processed to improve signal and tone quality. Therefore, in this design, the actuator is given priority over the sound sensor, and is placed on the optimal location of the soundboard (near the bridge). The sound sensor is then placed as far as possible from this location in order to reduce feedback. The incoming signal from the sound sensor is then processed in order to restore the quality and tone of the signal that was lost through non-optimal placement. Any remaining feedback is cancelled through a variety of feedback cancellation techniques including notch filtration and noise gating. This processing and digital feedback cancellation is made easier through the fact that the sound sensor is integral to the device and therefore is of known properties. For example, the sensor may exhibit resonance at certain known frequencies which can, in turn cause feedback at those frequencies. Notch filters can then be permanently set at those known frequencies. As a second example, the sensor may produce an electronic signal at a known dynamic range, and therefore the system or user does not have to adjust for the incoming signal being at too high or low of a volume. All of these factors, combined together, create a feedback profile that is knowable and manageable, such that the feedback can be repeatably and reliably cancelled.

The design of the device and the specific attachment mechanism may be such that they dictate the positions of the sound sensor and actuator and therefore allow feedback effects to be characterised and minimised more easily. The device may also self-calibrate to minimise feedback effects, or be pre-calibrated to minimise feedback effects. The feedback minimisation and/or self-calibration may be achieved by analysing the feedback spectrum of the guitar, for example.

The feedback minimisation may also be achieved by introducing a delay in the processing of the signal from the sound sensor, with the electronic circuitry for example. The delay introduced may be approximately 5 ms, for example.

The device is ergonomic and easy to use due to its preferably tapered and unobtrusive shape which allows for a musician to play their instrument as they would in the absence of the device (for example, guitarists can perform palm mutes in the usual way).

The device may be made from any suitable material including plastic and/or rubber. The device may be made from a polycarbonate ABS mix and/or injection moulded plastic.

The device may be removably coupled to the musical instrument with the engagement, which allows it to be used flexibly, for example, to be fixed to the musical instrument during a musical performance (or part of a musical performance) and then removed at the end of the performance, for example.

The device may have external accessories including but not limited to:

a recording device;

a device for inputting backing music and/or other music to be outputted by the device;

a case for protecting and/or carrying the device; and a palm muting member to give more flexibility in muting (percussive vs. melodic).

The wire connecting the sound sensor to the controller may be comprised in the elastic strap of the device. The sound sensor may also be provided as a separate module that can be attached to the device via an input.

It will be appreciated that the device of the present invention may be used, suitably modified, on any instrument that has a vibrating membrane as part of the production of sound.

It will be understood that the present invention has been described above purely by way of example, and modifications of detail can be made within the scope of the invention, as would be understood by skilled persons.

What is claimed is:

1. An accessory for modifying sound output of a musical instrument, the musical instrument comprising a body, the body comprising a soundboard, in which the accessory comprises:

a sound sensor configured to engage the body and sense vibration of the body representing the sound output of the musical instrument;

an actuator configured to engage the soundboard and deform the soundboard of the musical instrument so as to modify the sound output of the musical instrument;

a fastener for engaging the accessory to the musical instrument, thereby to locate the actuator against the soundboard of the musical instrument;

a controller in electronic communication with the actuator and the sound sensor for receiving and analysing the sound output sensed by the sound sensor, and controlling the actuator in dependence on the sound output sensed by the sound sensor; and a switch for deactivating the sound sensor.

2. An accessory according to claim 1, wherein the musical instrument is a stringed instrument.

3. An accessory according to claim 1, wherein the sound sensor is a piezoelectric pickup.

4. An accessory according to claim 1, wherein the fastener is arranged to locate the actuator proximate a sound hole of the musical instrument.

5. An accessory according to claim 2, wherein the fastener is arranged to locate the actuator proximate the strings of the musical instrument.

6. An accessory according to claim 1, wherein the fastener is arranged so as to locate the actuator on an external surface of the musical instrument.

7. An accessory according to claim 1, wherein the fastener is arranged so as to locate the actuator on a soundboard of the musical instrument.

8. An accessory according to claim 1, wherein the fastener is arranged so as locate the actuator between the bridge or saddle and the strap pin or endpin.

9. An accessory according to claim 1, wherein the fastener comprises a securing formation for engaging the accessory to the bridge or saddle or of the musical instrument.

10. An accessory according to claim 1, wherein the fastener comprises a securing member for engaging the accessory to a strap pin or an endpin of the musical instrument.

11. An accessory according to claim 1, wherein the fastener is, at least in part, formed from an elastic material.

12. An accessory according to claim 1, further comprising a housing within which the actuator is housed.

13. An accessory according to claim 12, wherein the fastener is integral with the housing.

14. An accessory according to claim 1, wherein the sound sensor is integral with the accessory.

15. An accessory according to claim 1, wherein the sound sensor is integral with or fixed to the fastener.

16. An accessory according to claim 1, wherein the sound sensor is arranged distally to the actuator.

17. An accessory according to claim 1, wherein the fastener is a conduit for an electrical connector connecting the sound sensor and the actuator.

18. An accessory according to claim 1, wherein the controller is configured to control the actuator so as to modify the sound output of the musical instrument thereby to effect: a delay effect; a reverberation effect; a distortion effect; quietening and/or loudening; and/or a noise gating effect.

19. An accessory according to claim 1, wherein the controller is configured to induce a delay to the actuation of the actuator.

20. An accessory according to claim 1, wherein the controller is configurable to control the actuator independently of the sound sensed by the sound sensor.

21. An accessory according to claim 1, further comprising a user input, wherein, in use, the user input is arranged at the front of the musical instrument.

22. An accessory according to claim 1, wherein the actuator comprises a damping member for contacting the surface of the musical instrument.

23. An accessory according to claim 1, further comprising an electric port for inputting or outputting an audio signal.

24. An accessory according to claim 2, further comprising a hinged member for contacting the strings so as to simulate a palm mute.

* * * * *